United States Patent [19]

Bachus et al.

[11] 4,426,255

[45] Jan. 17, 1984

[54] WIRE INSULATING METHOD AND APPARATUS

[75] Inventors: Benson F. Bachus; Georg C. E. Dornberger, both of Phoenix, Ariz.

[73] Assignee: Western Electric Company, Inc., New York, N.Y.

[21] Appl. No.: 353,666

[22] Filed: Mar. 1, 1982

[51] Int. Cl.[3] ..... D21D 3/00

[52] U.S. Cl. ..... 162/106; 162/192; 162/198; 162/255; 162/263; 162/268

[58] Field of Search ..... 162/192, 198, 106, 263, 162/255, 268, 262; 324/54, 236, 239, 240, 257

[56] References Cited

U.S. PATENT DOCUMENTS

| | | | |
|---|---|---|---|
| 1,615,421 | 1/1927 | Walker et al. | 162/268 |
| 2,326,344 | 8/1943 | Elmendorf et al. | 340/677 |
| 3,467,855 | 9/1969 | Rance | 324/3 |
| 3,808,524 | 4/1974 | Tarassoff et al. | 324/34 R |

OTHER PUBLICATIONS

"Manufacturing Pulp Cable", Britz et al., *The Western Electric Engineer,* Jul.-Oct. 1971, pp. 86-94.

"Frequency Stability of Oscillators-Crystal Oscillators", *Radio Engineer's Handbook,* pp. 484-487.

*Primary Examiner*—Peter Chin

*Attorney, Agent, or Firm*—David P. Kelley

[57] ABSTRACT

Apparatus and method for insulating wires with pulp are disclosed wherein wires embedded in pulp ribbons supported upon an endless transfer belt are passed through radio-frequency electromagnetic fields generated by oscillators tuned to resonate at a high voltage level whenever a wire is not present and thereby energize a wire break alarm.

6 Claims, 7 Drawing Figures

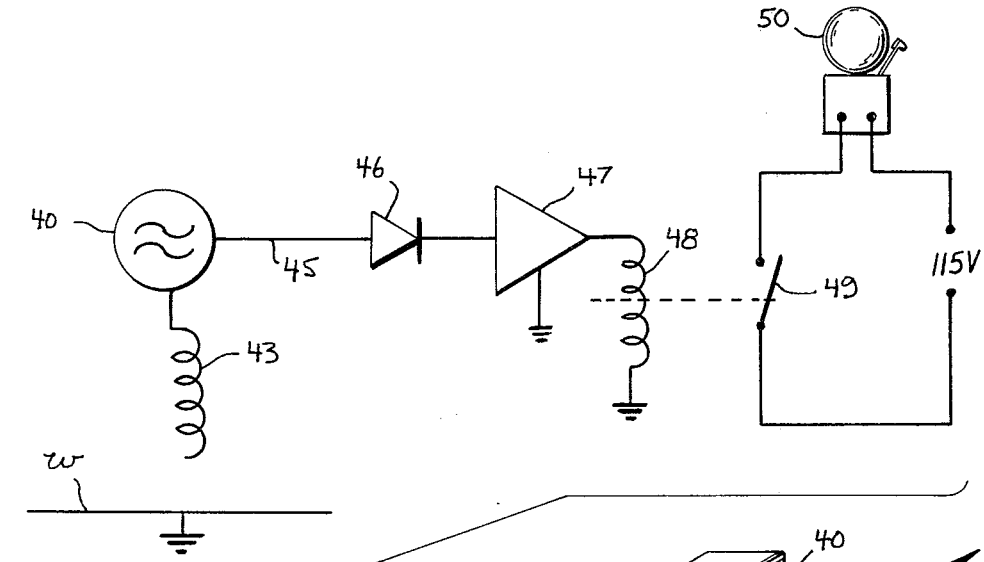
Fig. 2
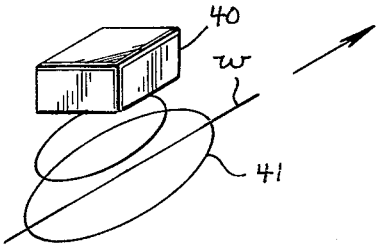
Fig. 3
Fig. 4
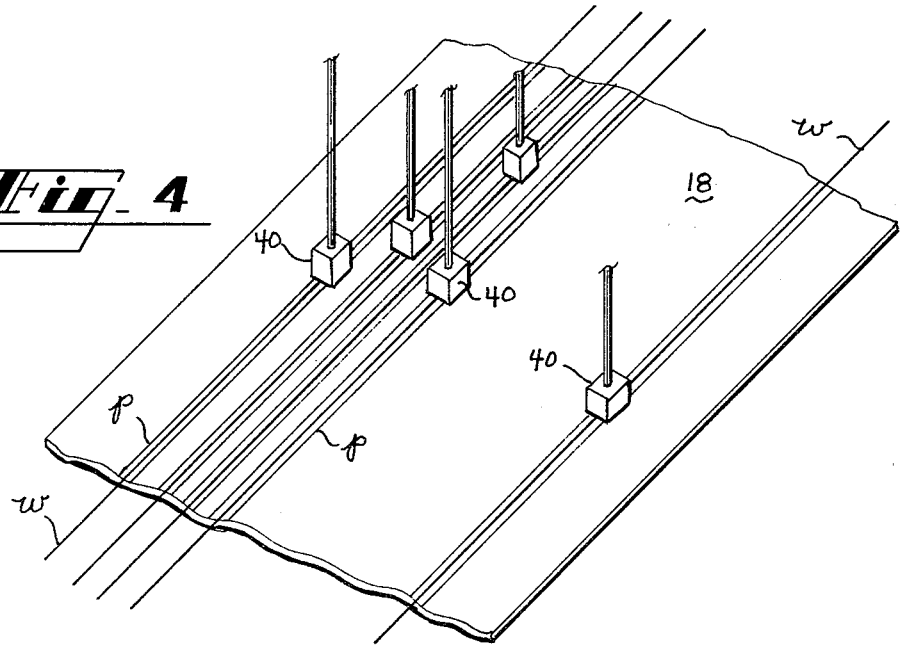

WIRE INSULATING METHOD AND APPARATUS

TECHNICAL FIELD

This invention relates to methods and apparatuses for insulating wires with pulp.

BACKGROUND OF THE INVENTION

Telecommunication wires today are often comprised of a copper wire surrounded by a layer of pulp insulation. During the insulation phase of its manufacture the copper wire is routed through a pulpous slurry bath and onto a cylinder mold where it is centered in a flat ribbon of wet pulp. The pulp ribbon and wire are then emersed from the bath, the ribbon spun about the wire, the now tubular shaped insulation partially dried in a furnace, and the insulated wire wound on a reel. All of this is typically done in a continuous, single pass operation at speeds of some 120 to 200 feet per minute simultaneously on a large number of wires.

More specifically, 60 copper wires are typically fed from 60 supply reels firstly through an electrolytic cleaner and then about a cylinder mold rotating in a vat of a pulpous slurry. The rotating cylinder mold is divided into 60 narrow, circumferential sections of exposed wire mesh separated by annular strips of a painted-on plastic where pulp is prevented from depositing. Individual ribbons of pulp are thus formed on the unpainted, exposed areas of the wire mesh. The copper wires are guided so that each wire is embedded in the center of one of the ribbons as they are formed. Once formed the wet, pulpous ribbons with the embedded wires are transferred from the cylinder mold onto an endless, transfer belt made of felt. The belt, ribbons and wires are then passed through a pair of rubber press rollers that press out some water from the ribbons. At this point the ribbons are about 5/16 inch wide and form an insulation thickness that varies from 0.007 to 0.016 inch, depending on wire size. The wet ribbons are next spun about the wires by passing them through a high speed, rotating polisher. Finally, the insulation is dried to about 7% moisture content by weight by passing it through a furnace. For a more detailed explanation of this process reference may be made to the July–October 1971 issue of *The Western Electric Engineer* and to the article appearing therein on pages 86–94 titled *Manufacturing Pulp Cable* by Chester Britz and William P. Klein.

During the just described process it sometimes happens that one of the wires breaks as it is being insulated. If such a break occurs at a point where the wire is adjacent to, or actually in contact with the cylinder mold, the wire will start wrapping around the mold. After a few convolutions of wire have built up on the cylinder mold the accumulation will scrape on the transfer belt, and the couch roll that guides the belt into contact with the cylinder mold, and sometimes even on the vat walls themselves. This action generates substantial noise. If the accumulation has not already been spotted by an attendant the attendant may hear this noise, realize that a wire break has occurred, and stop the manufacturing line. Unfortunately, the accumulation of broken wire will often at this point already have damaged the cylinder mold by bending and twisting it. Moreover, once several convolutions of wire have been built up the wire itself becomes quite entangled and difficult to remove from the mold. It thus would be desirable to have the wire insulation apparatus include means for detecting a wire break in a more rapid manner so that the pulp insulating apparatus or machine could be halted before substantial damage and wire removal inconvenience had occurred.

Wire and metal detectors, of course, are available for confirming the presence of wires. By and large, however, they are not suitable for incorporation into wire insulating machines of the type described. For example, with many detectors a wire under surveillance or test must be passed through an inductive, coil member of a tuned, electronic circuit that oscillates under certain structural conditions of the wire. U.S. Pat. No. 2,326,344 is exemplary of this type test procedure. Obviously, it would be almost impossible to have a substantial number of continuous wires embedded in a multiplicity of pulp ribbons upon a single, endless belt of a pulp insulating machine pass through an array of such coils. Furthermore, the electronic circuitry employed creates oscillations when a normally structured wire is present and ceases oscillations when abnormalities appear as where portions of the wire metal are absent. Thus, were the wires to be passed outside of the coils they would have to be held precisely in spatial relation with the coil to avoid erroneous signals from being generated.

Other metal detectors employ oscillator frequency change as a wire or metal detection technique. For example, U.S. Pat. No. 3,467,855 illustrates a metal detector having means for establishing a field of radio-frequency (RF) energy, which throughout this application means frequencies in excess of one megahertz, that includes an inductor coil adapted to be passed in proximity to an object to be detected. This device has an RF output signal altered by disturbances in the radiated field when the inductor is in proximity with a metallic object. The device also has means for bearing the RF output with that of a constant frequency FR output to produce an alternating current signal at a beat frequency which vary in response to frequency changes in the first RF signal caused by the disturbances. Unfortunately, this type of detector is expensive and complicated requiring the use of frequency meters, phaseshift indicators, means accomodating for oscillator frequency drift and the like. Furthermore, since a pulp insulating machine would require a multitude of such indicators in close proximity to each other, additional circuit design sohpistication would be required to avoid interference between the various fields.

SUMMARY OF THE INVENTION

In one form of the invention apparatus for insulating a wire with pulp comprises a vat adapted to contain a pulpous slurry, a cylinder mold mounted for rotation within the vat partially submerged in and partially emerged from the pulpous slurry, and an endless belt mounted for movement along an endless path that contacts the cylinder mold at a slurry emerged location. So constructed, a wire may be routed into the vat, over the cylinder mold and onto the endless belt embedded in a ribbon of pulp transferred from the mold to the belt. The apparatus further comprises radio-frequency oscillator means for propagating an electromagnetic field through which the endless path passes and for detecting the absence of the wire therewithin embedded in a ribbon of pulp supported upon the belt. The apparatus also has means for generating a wire break signal upon the detection by the electric field propagating and detecting means of the absence of the wire within the electric field.

In another form of the invention a method of insulating a wire with pulp comprises the steps of passing a wire into a pulpous bath, emerging the wire embedded in a ribbon of pulp from the pulpous bath, passing the wire and ribbon through an electromagnetic field generated by an oscillator tuned to resonate at radio-frequency and at a relatively low output voltage level with the wire present in the field and to resonate at radio-frequency and at a relatively high output voltage with the wire absent from the field, and generating a wire break signal in response to the oscillator commencing to resonate at the relatively high output voltage level.

BRIEF DESCRIPTION OF THE DRAWING

FIG. 2 is a schematic illustration of the electromagnetic field propagating and wire absence detecting means of the wire break signaling means components of the apparatus shown in FIG. 1;

FIG. 3 is a schematic illustration of one electric field generated by the apparatus shown in FIG. 1 through which one wire is being passed;

FIG. 4 is a schematic illustration of several of the wire break detector and signaling means illustrated in FIGS. 2 and 3 for a number of wires being advanced through the pulp insulation apparatus as shown in FIG. 1.

DETAILED DESCRIPTION

Figure 1:
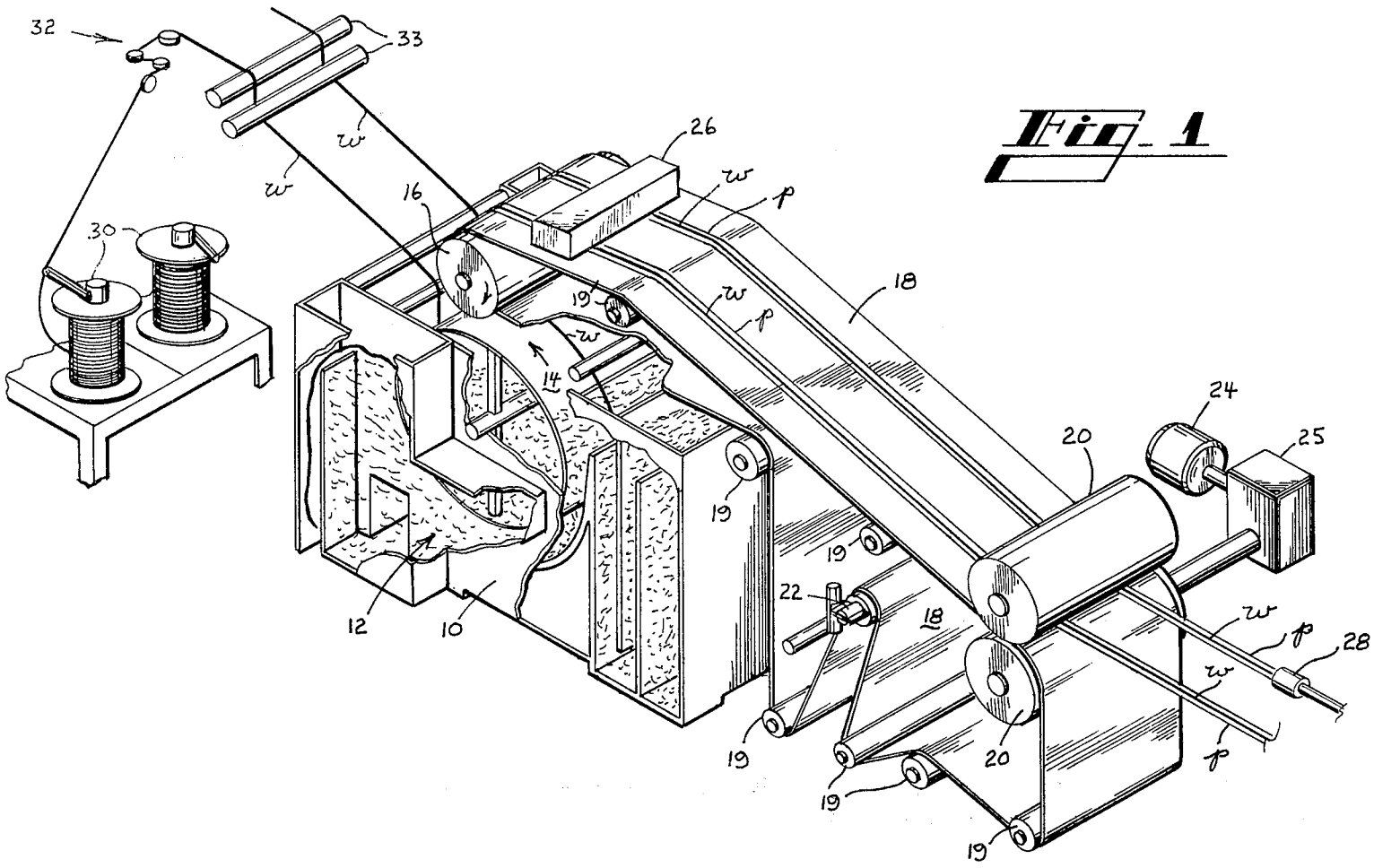
FIG. 1 is a perspective view of pulp insulation apparatus embodying and utilizing principles of the present invention.

With reference to FIG. 1 pulp insulating apparatus is seen to include a vat or tank 10 in which is contained a pulp and water slurry 12. A cylinder mold 14 rotates partially submerged in and partially emerged from the slurry. As previously stated the cylinder mold is formed of wire mesh selectively coating with annular strips of a painted-on plastic material where deposition of pulp is prevented from occurring. A couch roll 16 is mounted above an emerged portion of the cylinder mold. An endless, felt, transfer belt 18 is wrapped over the couch roll, over a series of support and guide rolls 19, through a pair of press rolls 20 and over a tension roll 22. The lower press roll is driven by a motor 24 via a gear reduction box 25. Wire break detection apparatus 26 is located just above the transfer belt 18 between the couch roll 16 and the uppermost support and guide roll 19'. This apparatus is electrically coupled with an alarm bell which is shown in FIG. 2 but not in FIG. 1. Polishers 28 are positioned downline from the press rollers 20 through which wires w embedded in ribbons of pulp p are passed. These polishers serve to lap the flat ribbons of pulp about the wires. Exemplary of one such polisher is that disclosed in U.S. Pat. No. 1,615,421.

In operation sixty wires w are drawn by unshown capstan means from sixty supply reels 30 through a tensioning device 32 and input rollers 33 into the vat 10 beneath the rotating cylinder mold 14 along annular, exposed wire mesh portions of the mold between its annular, coated areas. As the wires travel through the vat ribbons of pulp p are formed about them upon the annually sections of the mold's exposed wire mesh. As the wires w emerge from the slurry they are brought by the rotating cylinder mold into contact with the transfer belt 18 at a point where it starts to wrap about the couch roll 16. As the ribbons of pulp adhere better to felt than to wire mesh they are transferred to the transfer belt along with the wires. The ribbons of pulp p with the wires w centered thereon are then passed beneath the wire break detection apparatus 26, over the uppermost support roll 19', which prevents the belt from whipping as it passes beneath the detection apparatus 26 more than 1/32 inch, and then through the press rolls 20 which squeeze out excessive water. The wires and ribbons are then passed through polisher 28 which wrap the ribbons about the wires to encompass or surround them completely. The now insulated wires are next passed through an unshown furnace which reduce the moisture content of the pulp insulation.

FIGS. 2–4 show that the wire break detection apparatus 26, and its associated signaling means, comprise an independent RF oscillator 40 positioned to project from its antenna 43 an RF field 41 into the path of each of the wires which are all grounded. As shown in FIG. 4 adjacent oscillators are staggered along the path of travel of the wires atop the belt 18 so as to avoid overlap and interference between the electromagnetic fields emitted by the oscillators. In FIG. 2 the oscillator 40 is generally shown to have an inductor or col 43 that functions as an antenna in projecting an RF field 41 into the path of the travel of a wire w. As hereafter described in more detail the output voltage level of the oscillator is utilized so as to generate a signal that is transmitted along line 45 through a rectifying diode 46 to a differential, operational amplifier 47. The line 45 from the other oscillators 40 may also be fed into this same amplifier 47 via logic gates. The differential amplifier compares the d.c. voltage level of the imputted signals with that of a preselected voltage level, all of which are referenced with ground. If the voltage is sensed to have reached a preselected level the amplifier emits a signal to a relay coil 48 which closes a relay switch 49. The closing of the switch 49 impresses 115 volts a.c. across a bell 50 in sounding an alarm indicative that one of the wires has broken. Upon hearing this alarm an attendant may quickly shut down the insulating line. If desired, an individual alarm may be provided for each wire to expedite the identification of the particular wire that has been broken. In that case an individual amplifier 48 and alarm light activating circuit would be employed for each oscillator.

Figure 5:
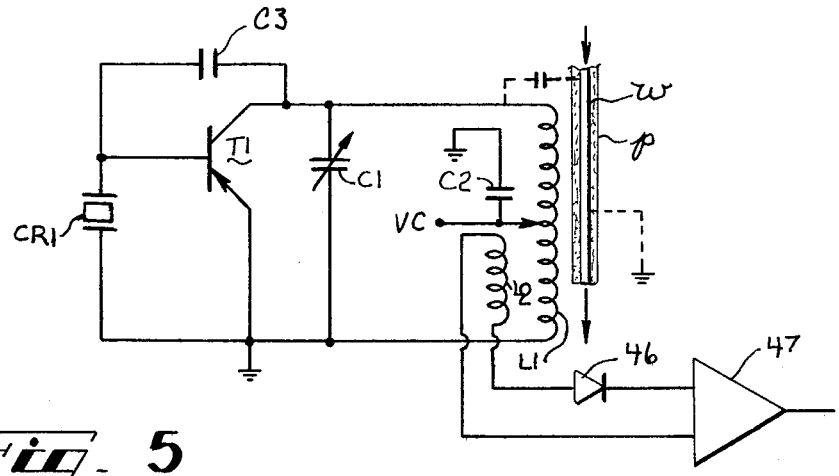
FIGS. 5, 6, and 7 illustrate three specific electronic circuits that may be employed as the wire break detecting and signaling means shown generally in FIG. 2.
Figure 6:
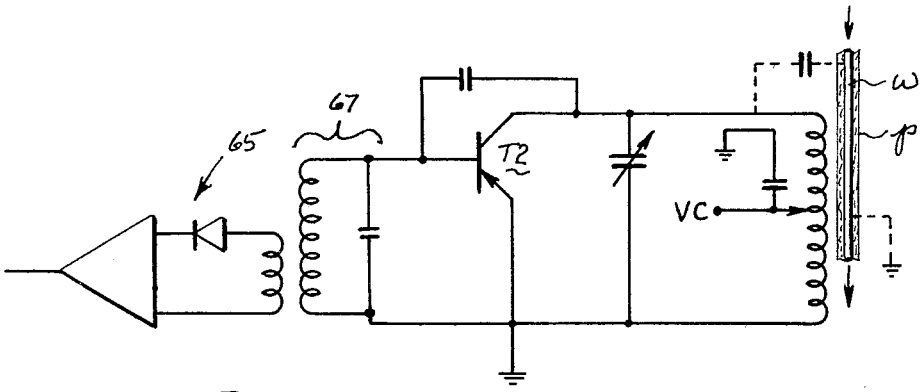
Figure 7:
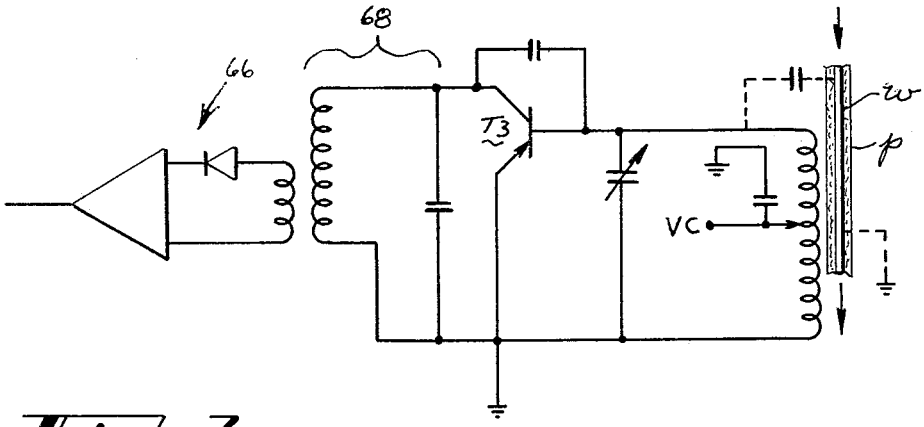

With reference next to FIGS. 5–7 three specific circuits are provided for detecting the absence of a wire on the transfer belt as generally illustrated in FIG. 2. In FIG. 5 an oscillator is shown having an LC resonant circuit tuned with a piezoelectric resonant circuit, the LC circuit being connected across a transistor collector and emitter and the piezoelectric circuit connected across the emitter and base of the same transistor. The LC circuit comprises an inductor L1 and a variable capacitor C1 connected across a transistor T1 emitter and collector in traditional tank circuit fashion. d.c. power VC is tapped into the inductor with a blocking capacitor C2 provided between ground. The piezoelectric resonate circuit has a piezoelectric crystal CR1 connected across the transistor base and emitter. Regeneration control capacitor C3 is provided between the two loops connected across the transistor collector and base. Another inductor L2 is provided in coupling relation with the inductor L1 as part of a signal circuit. The inductor L2 is connected through a diode 46 to the differential, operational amplifier 47 as shown in FIG. 2. One set of values for the components of this circuit is provided below in Table I for use with 26 gauge copper wires spaced approximately 1/16 inch from the inductor L1:

TABLE I

| | |
|---|---|
| T1 | 2N404 |
| C1 | 100 nf |
| C2 | .02 μf |
| C3 | 1000 pf |
| CR1 | Western Electric 34NA |
| VC | −12 VDC |
| L1 | 100 μH |
| L2 | 100 KΩ impedance @ 50 KHz |
| 46 | 1N456 |
| 47 | SN52741 |

Preferably, the oscillators transmit at a frequency of about 50 KHz and have the following characteristics. Their antennas, i.e., inductors adjacent the wires w, are shaped such that a longitudinal pattern is developed in the direction of wire movement as shown in FIG. 3. Their beams are less than 1-1/16 inches wide at the wire when the oscillators are staggered. If not staggered a beam width of ⅜ inches gives good detection sensitivity. Coils of about 180 turns of number 36 wire with an ID of ½ inch, OD of ⅜ inch, and about ⅜ inch length give good results. A one inch long ferrite may be used to achieve the elongated pattern. For most telecommunication wire gauges the distance the wires pass adjacent the oscillator inductor/antenna should be less than ⅛ inch.

In operation, a wire w embedded in a ribbon of pulp p passes beside the inductor or coil L1 within its RF electromagnetic field thereby loading the oscillator. In this condition the LC and crystal circuits fail to resonate with a high Q and the voltage induced across the inductor L2 is insufficient to close the alarm bell switch 49. However, whenever the wire ceases to be present the impedance of the inductor L1 increases whereupon the current drawn by it decreases, the voltage across it increases and the oscillator achieves a higher quality of resonance. With the increase in voltage across L1 the voltage across the inductor L2 also increases to a level which, when rectified by diode 46, presents a d.c. voltage across the differential operational amplifier 47 sufficient to cause it to emit the alarm activating signal as earlier shown in FIG. 2.

FIGS. 6 and 7 illustrate two alternate circuits in which the output voltage of an oscillator is again used to trigger a broken wire alarm signal. Here, each oscillator comprises two resonant LC circuits as opposed to the single LC circuit employed in FIG. 5. In FIG. 6 a tuned-collector type oscillator is shown having a collector-emitter tank circuit of which a wire w loaded inductor is a part. Here, the LC resonant circuit associated with the wire w is coupled across the emitter and collector of a transistor T2. In FIG. 7 a tuned collector type oscillator is again shown. Here however the inductor loaded with the wire w is a part of a emitter-base tank circuit with the LC resonant circuit associated with the wire being coupled across the base and emitter of a transistor T3. Another distinction between the circuits is that with the circuit in FIG. 5 the alarm signal circuit is inductively coupled to the inductor of the LC circuit of the oscillator associated with the wire whereas in FIGS. 6 and 7 the inductors of the signal triggering circuits 65 and 66, respectively, are coupled with the inductor of the feedback resonant circuits 67 and 68, respectively.

It thus is seen that an apparatus and a method are provided for insulating wires with pulp for use in telecommunications. It should however be understood that the just described embodiments merely illustrate principles of the invention in selected, preferred forms. Many modifications, additions and deletions may, of course, be made thereto without departure from the spirit and scope of the invention as set forth in the following claims.

What is claimed is:

1. Apparatus for insulating a wire with pulp comprising, in combination, a vat adapted to contain a pulpous slurry, a cylinder mold mounted for rotation within said vat partially submerged in and partially emerged from the pulpous slurry, and an endless belt mounted for movement along an endless path that contacts said cylinder mold at a slurry emerged location whereby a wire may be routed into the vat, over the cylinder mold and into the endless belt embedded in a ribbon of pulp transferred from the mold to the belt, and wherein said apparatus further comprises radio-frequency oscillator means for propagating an electromagnetic field through which said endless path passes and for detecting the absence of the wire therewithin embedded in a ribbon of pulp supported upon said belt, and means for generating a wire break signal upon the detection by said electric field propagating and detecting means of the absence of the wire within the electric field.

2. Wire insulating apparatus in accordance with claim 1 further comprising a couch roll over which said endless belt passes in point contact with said cylinder mold, and wherein said electromagnetic field propagating and wire absence detecting means is located closely adjacent said couch roll for propagating the electric field through the endless path and belt at a position adjacent the couch roll.

3. Wire insulating apparatus in accordance with claim 1 for insulating a plurality of wires simultaneously and further comprising a plurality of said radio-frequency oscillator means for propagating a plurality of electromagnetic fields through which said endless path passes and for detecting the absence of a conductive wire within any one of the electric fields, and wherein adjacent fields are located at longitudinally offset locations along said path to inhibit field overlap and interference.

4. Wire insulating apparatus in accordance with claim 1 wherein said radio-frequency oscillator means for propagating an electric field and for detecting the absence of a conductive wire therewith comprises a resonant circuit having an inductor located closely adjacent said endless path from which the electronic field is propagated and which circuit is tuned to resonate at a high Q only when the electromagnetic field is loaded with a conductive wire.

5. Wire insulating apparatus in accordance with claim 4 wherein said signal generating means includes an electric circuit coupled with said radio-frequency oscillator means for generating a wire break signal upon sensing the output voltage of the radio frequency oscillator means to have exceeded a selected magnitude.

6. The method of insulating a wire with pulp comprising the steps of passing a wire into a pulpous bath, emerging the wire embedded in a ribbon of pulp from the pulpous bath, directing the wire embedded in the ribbon of pulp onto an endless belt, passing the wire and ribbon while supported on the endless belt through an electromagnetic field generated by an oscillator tuned to resonate at radio-frequency and at a relatively low output voltage level with the wire present in the field and to resonate at radio-frequency and at a relatively high output voltage with the wire absent from the field, and wrapping and drying the ribbon of pulp about the wire or generating a wire break signal in response to the oscillator commencing to resonate at the relatively high output voltage level.

* * * * *